US009630193B2

(12) United States Patent
Hawkins

(10) Patent No.: US 9,630,193 B2
(45) Date of Patent: Apr. 25, 2017

(54) SHOWERHEAD WITH EXTENDABLE HANDLE

(71) Applicant: FAN FI INTERNATIONAL, INC., Reno, NV (US)

(72) Inventor: Travis Hawkins, Reno, NV (US)

(73) Assignee: FAN FI INTERNATIONAL, INC., Reno, NV (US)

( * ) Notice: Subject to any disclaimer, the term of this patent is extended or adjusted under 35 U.S.C. 154(b) by 0 days.

(21) Appl. No.: 15/078,251

(22) Filed: Mar. 23, 2016

(65) Prior Publication Data

US 2016/0279648 A1 Sep. 29, 2016

Related U.S. Application Data

(60) Provisional application No. 62/136,727, filed on Mar. 23, 2015.

(51) Int. Cl.
*B05B 1/18* (2006.01)
*B05B 15/06* (2006.01)

(52) U.S. Cl.
CPC ..... *B05B 1/18* (2013.01); *B05B 15/064* (2013.01)

(58) Field of Classification Search
CPC B05B 1/18; B05B 1/185; B05B 15/06; B05B 15/061; B05B 15/064; B05B 15/065; B05B 15/068; B05B 15/069
USPC .... 239/280, 280.5, 281, 525, 530, 532, 548, 239/558–563, 567, 600; 285/145.1, 302; 403/109.1, 377; 138/114
See application file for complete search history.

(56) References Cited

U.S. PATENT DOCUMENTS

| | | | | |
|---|---|---|---|---|
| 2,257,585 | A * | 9/1941 | Auvil | B05B 15/068 239/530 |
| 2,776,168 | A | 1/1957 | Schweda | |
| 5,622,446 | A | 4/1997 | Hibberd | |
| 6,021,539 | A * | 2/2000 | Zhadanov | A46B 13/06 15/29 |
| 6,151,728 | A * | 11/2000 | Wright | A47K 7/046 4/606 |
| 6,158,469 | A * | 12/2000 | Yen | E03C 1/0404 137/801 |
| 6,322,006 | B1 * | 11/2001 | Guo | B05B 15/064 239/280 |
| 6,619,570 | B1 | 9/2003 | Ericksen et al. | |
| 6,789,751 | B1 | 9/2004 | Fan | |
| 6,913,211 | B2 | 7/2005 | Chen | |
| 7,770,822 | B2 | 8/2010 | Leber | |
| 8,230,882 | B2 | 7/2012 | Lacher | |
| 9,393,174 | B1 * | 7/2016 | Pope | A61H 7/005 |

(Continued)

FOREIGN PATENT DOCUMENTS

| | | |
|---|---|---|
| CN | 201150887 Y | 11/2008 |
| CN | 203076130 U | 7/2013 |

*Primary Examiner* — Darren W Gorman
(74) *Attorney, Agent, or Firm* — Russo & Duckworth, LLP; David G. Duckworth

(57) ABSTRACT

A handheld showerhead assembly is provided with an extendable handle. The showerhead assembly includes a handle having a proximal end affixed to a threaded hose and a distal end connecting to a traditional showerhead. The showerhead assembly's handle has a hollow housing for receiving an extension member. The extension member can be locked in a retracted or extended position by rotating the extension member relative to the handle's housing.

3 Claims, 4 Drawing Sheets

(56) References Cited

U.S. PATENT DOCUMENTS

| | | | | |
|---|---|---|---|---|
| 2006/0201562 | A1* | 9/2006 | Gloor | E03C 1/0404 137/801 |
| 2014/0117178 | A1 | 5/2014 | Vartanian et al. | |

* cited by examiner

SHOWERHEAD WITH EXTENDABLE HANDLE

RELATED APPLICATIONS

The present application is a continuation of co-pending U.S. Provisional Patent Application Ser. No. 62/136,727 filed on Mar. 23, 2015.

BACKGROUND OF THE INVENTION

The present invention relates to showerheads. More particularly, the present invention relates to handheld showerheads.

Spray heads are commercially available in numerous designs and configurations for use in showers, faucets, spas, sprinklers and other personal and industrial systems. Spray heads may be categorized as being either stationary or oscillating and may have fixed or adjustable openings. Stationary spray heads with fixed jets are the simplest construction consisting of a central conduit which connects a water source to one or more spray jets directed to produce a constant pattern. Multi-function spray heads are able to deliver water in different spray patterns such as a fine spray, a coarse spray, a pulsating spray, or even a flood pattern producing a high fluid flow.

A handheld showerhead assembly typically includes a hollow handle connected to a water supply by a flexible rubber hose. The handle has a proximal end which typically has a threaded inlet for connecting to the rubber hose. Meanwhile, at the handle's distal end, the showerhead assembly includes a showerhead including a plurality of nozzles for ejecting water. Typically, the handle and showerhead face are angled relative to one another so that water is ejected at approximately 90° relative to the handle's longitudinal axis.

Advantageously, the showerhead handle allows users to manipulate the spray nozzles into various positions and alignment to assist in the cleaning process. Unfortunately, though handheld showerheads provide many advantages compared to their fixed showerhead counterpart, handheld showerheads still suffer from several disadvantages. For example, handheld showerhead assemblies typically have a fixed handle length which prevent the shower handle from extending longitudinally in length. This results in many handheld shower assemblies not providing handles of sufficient length so as to allow a user to direct water to desired locations, such as one's back.

There have been attempts to develop handheld shower assemblies having extendable handles. For example, U.S. Pat. No. 7,770,822 describes a showerhead assembly having an extendable handle. The showerhead handle can be locked in an extended or retracted condition, but the lock is difficult to operate. Similarly, U.S. Pat. No. 6,789,751 discloses a showerhead assembly having a telescopically extendable handle. Again, the handle can be locked in an extended or retracted condition, but requires manipulation of a difficult to operate button.

Accordingly, there is a need for a showerhead assembly having an extendable handle.

Furthermore, there is a need for a showerhead assembly having an extendable handle wherein the handle can be more easily locked in a retracted or extended condition.

SUMMARY OF THE INVENTION

The present invention addresses the aforementioned disadvantages by providing an improved handheld showerhead assembly with an extendable handle. The showerhead assembly includes a traditional showerhead including a plurality of nozzles for spraying water such as within a shower. In addition, the showerhead includes a conduit having an inlet for receiving water for being expelled from the showerhead nozzles. Various conduit and nozzle constructions can be determined by those skilled in the art.

The showerhead assembly also includes an elongate extendable handle which connects to the showerhead's inlet. The handle is elongate so as to define a longitudinal axis, and preferably the distal end of the handle affixes to the showerhead at an angle, such as 45°-90°. The elongate handle has a telescopic construction including an extension member which telescopically slides within a housing.

The housing has a tube-like structure including a central conduit. The housing's proximal end connects to a water source such as a hose. Meanwhile, the housing's distal end includes a ring having a circular opening which has a diameter smaller than the diameter of the housing's central conduit. In addition, the housing's ring includes at least one slot which forms an edge.

The extension member telescopically slides within the external housing's central conduit and the housing ring's opening. The extension member is also elongate and has a substantially annular construction so as to have an elongate cylindrical outer surface and central conduit which has an axis coincident with the longitudinal axis of the elongate handle and its external housing. The extension member's proximal end is positioned within the external housing's central conduit and the extension member's distal end is connected to the showerhead's inlet. Advantageously, the extension member's exterior diameter is substantially the same as the ring's inner diameter so as to allow the extension member to telescopically slide within the external housing from a retracted condition to an extended condition, and vice versa.

To provide a locking mechanism for locking the extension member in either an extended condition or a retracted condition, the extension member has at least one guide which extends through the ring's slot. Preferably, the housing's ring has multiple slots, and the extension member has multiple corresponding guides, wherein each guide is formed upon the cylindrical surface of the extension member. Each guide includes a longitudinal ridge which extends longitudinally substantially the length of the extension member. Furthermore, each guide includes proximal and distal lateral ridges, and proximal and lateral stop ridges. Each proximal lateral ridge has a first end which connects to the proximal end of the longitudinal ridge and the proximal lateral ridge extends laterally and circumferentially about the exterior of the extension member so as to terminate at the proximal lateral ridge's second end. Similarly and conversely, the guide's distal lateral ridge has a first end which extends from the longitudinal ridge's distal end laterally and circumferentially about the exterior of the extension member to terminate at its second end. Both the proximal and distal lateral ridges have a length sufficiently small so as to slide through a corresponding slot. The length of the proximal and distal lateral ridges is smaller than corresponding slot so as to allow the ridges to telescopically slide through such slots as the extension member is extended and retracted. Each extension member's guide includes a proximal stop ridge and a distal stop ridge which are formed on the extension member's exterior surface. The proximal stop ridge extends in the longitudinal direction from the proximal lateral ridge's second end. Similarly, the guide's distal stop ridge extends longitudinally from the distal lateral ridge's second end.

As the extension member slides telescopically within the handle's housing, the guide's longitudinal ridge slides within a ring's slot. The longitudinal ridge within the slot prevents relative rotation of the extension member within the housing. Preferably, each housing ring includes a plurality of slots and the extension member includes a plurality of guides and their corresponding longitudinal ridges so to prevent relative rotation. Once the extension member has been slid to an extended condition, the guide's longitudinal ridges become positioned external to the housing's central cavity and the housing's ring so as to allow rotation of the extension member relative to the handle's housing. The extension member is rotated until a guide's proximal stop engages a slot's edge so as to lock an extension member in an extended condition until the extension member has been rotated back. Conversely, once an extension member has been slid to a retracted condition, a guide's longitudinal ridge becomes located entirely within the housing's central cavity and no longer capable of preventing rotation of the extension member relative to the handle's housing. Thus, the extension member is capable of being rotated until the guide's distal stop engages a slot edge so as to lock the extension member in a retracted condition until the extension member has been rotated back.

In one embodiment of the invention, a watertight seal is provided between the handle's housing and the extension member such as by the use of O-rings. In an alternative embodiment, the handle assembly includes an inner supply tube having a proximal end which connects to a water supply. The inner supply tube extends longitudinally within the handle's housing within the extension member's central conduit. One or more O-rings may be provided between the inner supply tube and the extension member's interior sidewall so as to provide a watertight seal.

Advantageously, the showerhead assembly includes an extendable handle for facilitating bathing and the use of the showerhead in various positions and alignment. Furthermore, the showerhead assembly allows one to lock the showerhead handle in either a retracted or extended position.

DETAILED DESCRIPTION OF THE INVENTION

Figure 1:
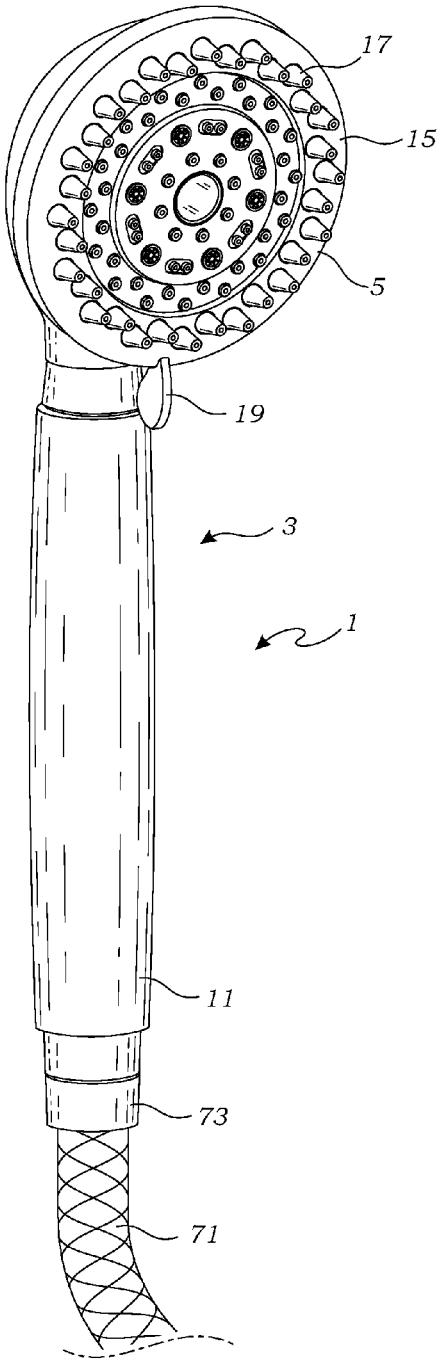
FIG. 1 is a perspective view of the showerhead assembly of the present invention with its extendable handle in a retracted condition.

While the present invention is susceptible of embodiment in various forms, as shown in the drawings, hereinafter will be described the presently preferred embodiments of the invention with the understanding that the present disclosure is to be considered as an exemplification of the invention, and the present disclosure is not intended to limit the invention to the specific embodiments illustrated.

Figure 2:
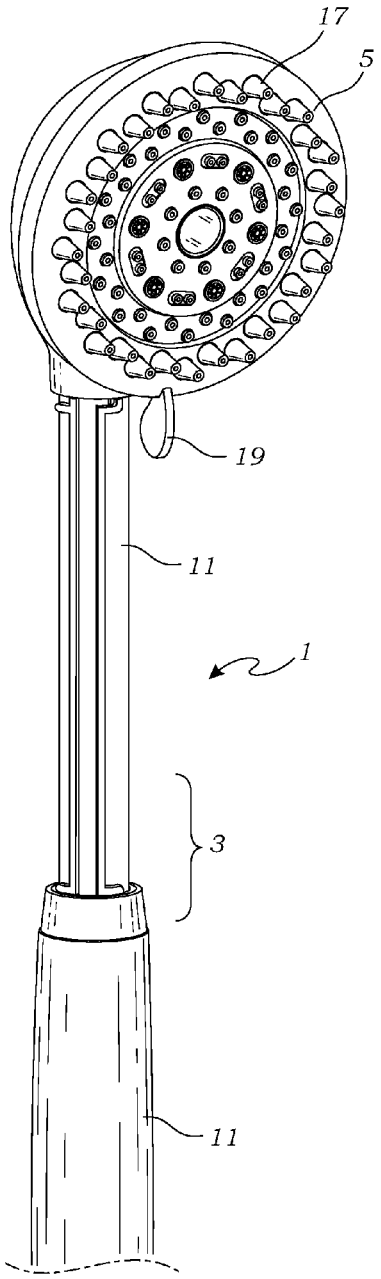
FIG. 2 is a perspective view of the showerhead assembly of the present invention with the extendable handle in an extended condition.
Figure 3:
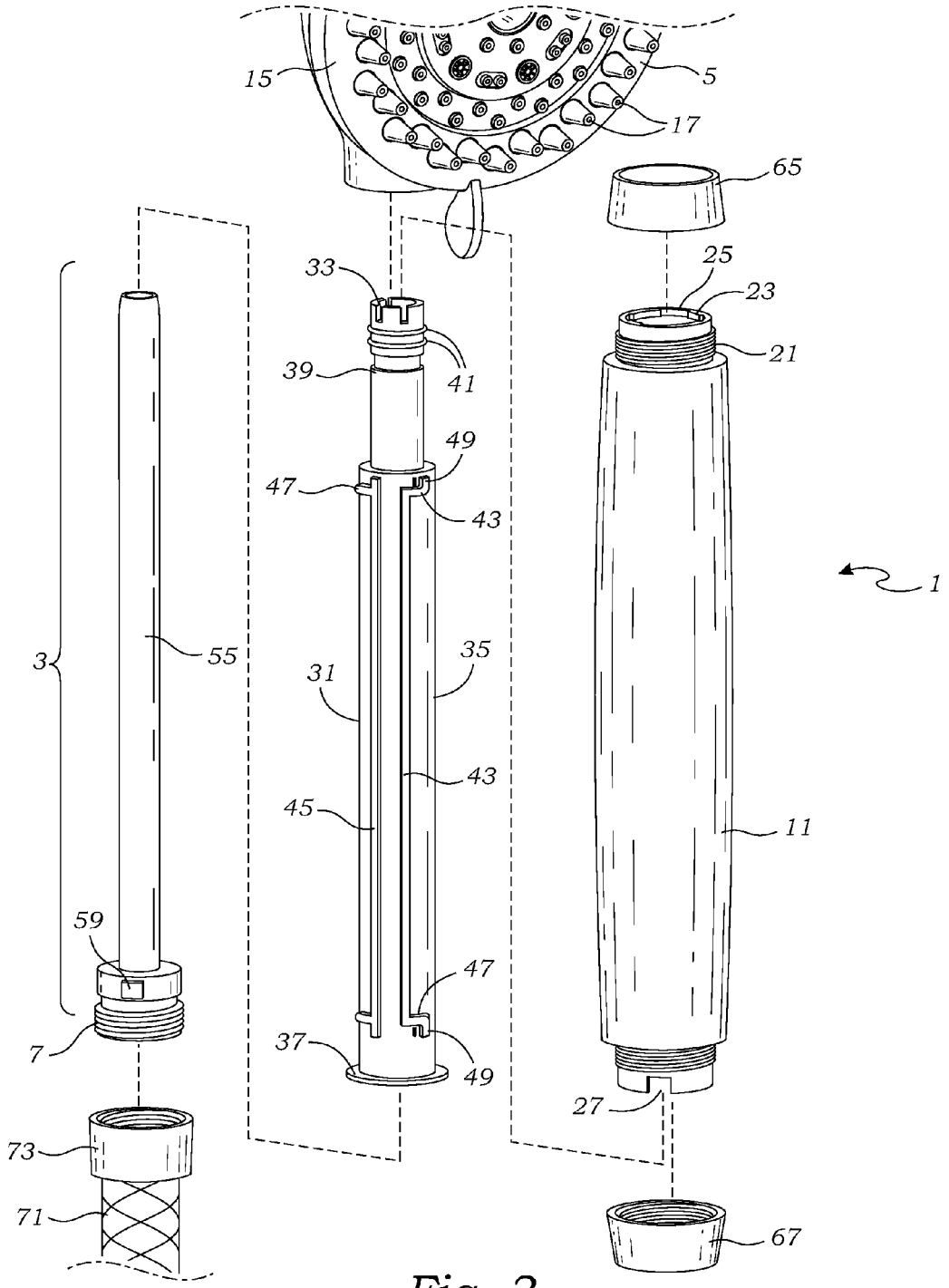
FIG. 3 is an exploded perspective view of the showerhead assembly of the present invention.

With reference to FIGS. 1-7, the showerhead assembly 1 includes an elongate handle assembly 3 having a proximal end including a male threaded inlet 7 for connecting to a water source, such as to the female threaded coupling 73 of a hose 71. (See FIG. 3). The rubber hose 71, in turn, is connected to household or commercial plumbing (not shown). The showerhead assembly includes a showerhead 5 affixed to the handle assembly's distal end. The showerhead 5 preferably has a relatively traditional construction including an external housing 11 and internal conduits (not shown) for diverting water to spray nozzles 17. The showerhead may be categorized as either stationary or oscillating and may have either fixed or adjustable openings. Moreover, the showerhead 5 may include a tab 19 for allowing a user to selectively divert water through different conduits to different spray nozzles 17. As illustrated in FIGS. 1-3, preferably the showerhead 5 includes a bend so that the showerhead's face 15 is at an angle relative to the longitudinal axis of the handle assembly 3.

Advantageously, the showerhead handle assembly 3 is constructed so as to be extendable. To this end, the preferred handle assembly 3 includes an external housing 9 having a central conduit 13. In addition, the housing preferably has upper and lower male threaded couplings 21 for receiving and affixing to an upper collar 65 and lower collar 67, respectively. The handle housing's distal end preferably includes an annular ring 23 which preferably projects radially inward from the housing's distal male threaded coupling 21. Meanwhile, the housing's annular ring 23 includes one or more slots 25.

Furthermore, the showerhead's handle assembly 3 includes an extension member 31. The extension member 31 is elongate and telescopically slides within the handle's housing 9. In addition, the extension member 31 has an annular sidewall 35 forming a central conduit 33. Preferably, the extension member 31 has a radially projecting stop 37 formed at the extension member's proximal end. Meanwhile, the extension member's distal end preferably includes a neck portion 39 for mating to the showerhead 5. As illustrated, preferably the extension member's neck 39 includes one or more rings 41 for providing a fluid tight seal with the showerhead 5.

As illustrated in FIGS. 1-7, the extension member 31 is capable of sliding telescopically within the handle's housing 9. To this end, the outer diameter of the extension member 31 is approximately the same size as the inner diameter of the housing's annular ring 23. To prevent unwanted relative rotation, the extension member 31 includes one or more guides 43 which project into a corresponding number of slots 25 formed in the annular ring 23. Each of the guides 43 include a longitudinal ridge 45 which slides within an annular ring's slot 25 as the extension member is extended or retracted. In a preferred embodiment, the extension member includes at least two guides 43 for sliding within two slots 25 formed in the annular ring 23. Even more preferably, and as illustrated in the drawings, preferably the extension member 31 includes four longitude guides 43 for sliding within four slots 25 formed in the annular ring 23. Moreover, it is preferred that the guides 43 be formed upon the extension member's outer sidewall so that at least one longitudinal ridge 45 is formed to slide longitudinally in a counterclockwise position in a corresponding slot 25, and at least one guide is positioned so that its longitudinal ridge 45 slides longitudinally in a clockwise position within a corresponding slot 25. Advantageously, the alternating positioning of the longitudinal ridges 45 inhibits relative rotation of the extension member 31 within the handle assembly's housing 11 as the extension member is extended or retracted.

Figure 4:
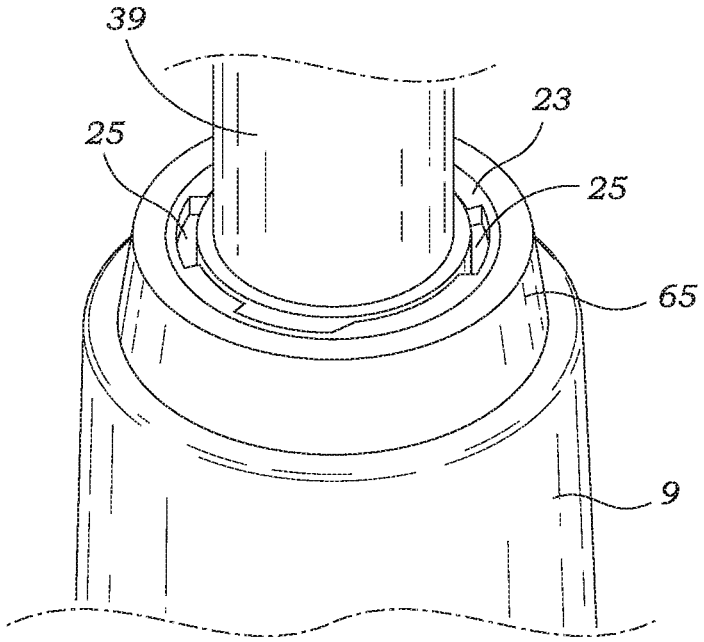
FIG. 4 is a perspective view illustrating the top of the showerhead assembly's handle with the handle in a retracted condition and the showerhead removed.
Figure 5:
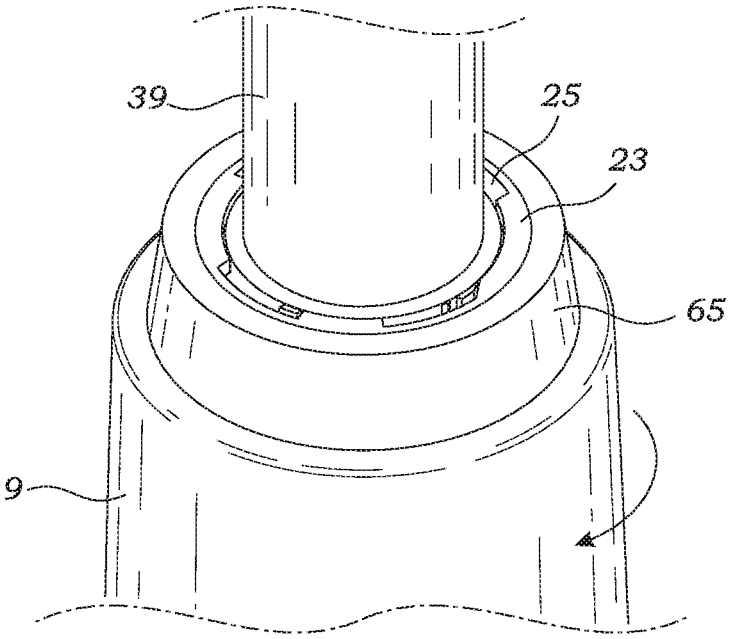
FIG. 5 is a perspective view illustrating the top of the showerhead assembly's handle with the handle's housing rotated to lock the showerhead assembly's extension member in a retracted condition.
Figure 6:
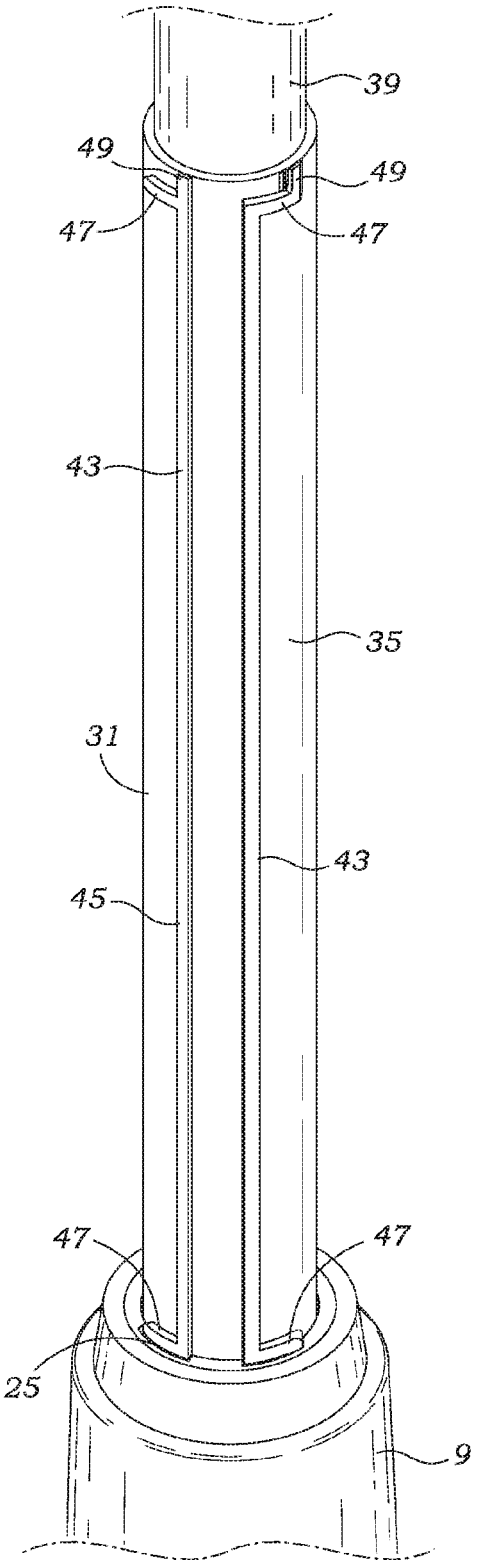
FIG. 6 is a perspective view of the showerhead assembly's handle in an extended condition and with the handle unlocked.
Figure 7:
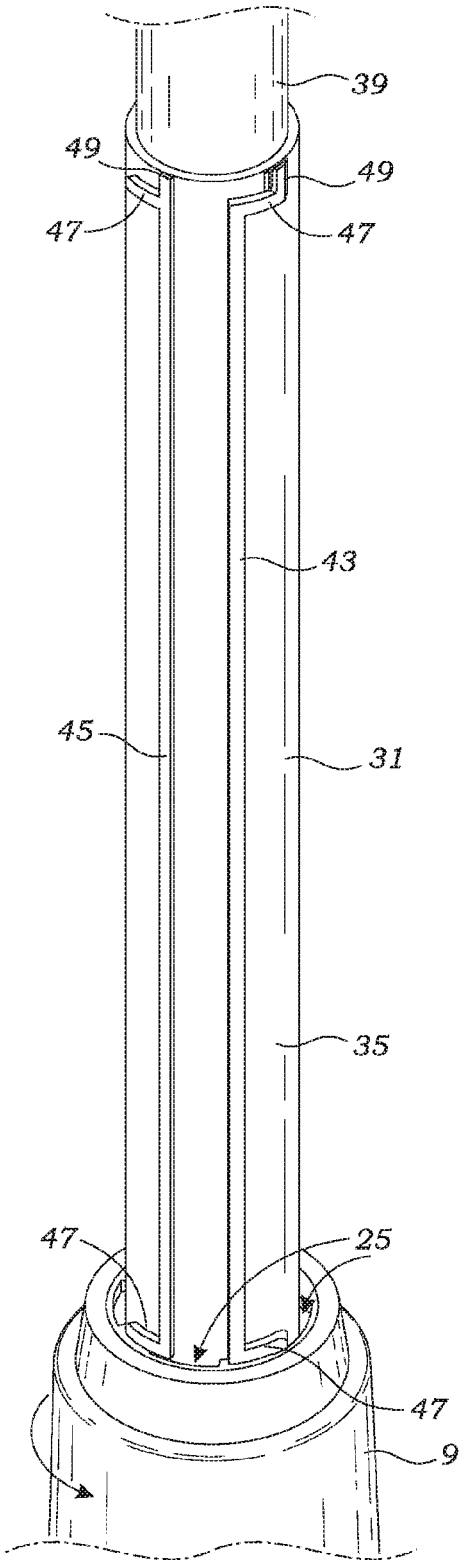
FIG. 7 is a perspective view of the showerhead assembly's handle in an extended condition with the handle's housing rotated to place the handle in a locked condition.

As best illustrated in FIGS. 3, 6 and 7, the extension member guides 43 also include proximal and distal lateral ridges 47, and short proximal and distal short stopping ridges 49. As illustrated in FIG. 4, the distally positioned lateral ridges 47 are sufficiently small so as to slide completely through the corresponding slots 25 in the annular ring 23 when the handle assembly 3 is retracted. As illustrated in FIG. 5, rotation of the handle's housing 9 relative to the extension member 31 then causes the lateral ridges 47 to slide under the annular ring 23 so as to prevent extension of the extension member 31 until the handle housing 9 has been rotated back to allow the guides' lateral ridges 47 to again slide through the annular ring's slots 25. Similarly, the guides' proximally positioned lateral ridges 47 are also sized sufficiently small so as to slide through the corresponding slots 25 formed in the annular ring 23. Accordingly, as illustrated in FIGS. 6 and 7, as the extension member is extended relative to the handle's housing 9, the guides' lateral ridges 47 are capable of sliding completely through their corresponding annular ring slots 25. Once the handle assembly 3 is completely extended, the handle's housing 9 can again be rotated relative to the extension member 31 so that the annular ring 23 rotates to slide under the guides' proximal lateral ridges 47 so as to prevent unwanted retraction of the extension member 31. Preferably, each guide 43 has a short longitudinally extending stopping ridge 49. These ridges 49 are positioned to engage the edge of an annular ring slot 25 so as to prevent unwanted and unnecessary rotation of the handle's housing 9 relative to the extension member 31. To prevent the extension member from extending too far so as to decouple from the handle housing 9, the extension member's stop 37 is sized to have a diameter too large to pass through the handle housing's annular ring 23.

In a preferred embodiment, the showerhead handle assembly 3 includes an inner supply tube 55 providing a fluid tight seal with the extension member's central conduit 33. The inner supply tube 55 is affixed to the proximal end of the handle's housing 9. As illustrated in FIG. 3, the rotation of the inner tube 55 is prevented relative to the handle's housing 9 by providing the inner supply tube with a projecting key 59 positioned within a notch 27 formed in the housing's proximal end. The inner supply tube 55 is preferably locked to the handle's housing 9 using a collar 67. One or more o-rings (not shown) may be provided between the inner supply tube's sidewall 55 and the interior sidewall of the extension member's central conduit 33 so as to provide a fluid tight seal.

To assemble the showerhead assembly 1 of the present invention, preferably the extension member 31 is slid into the handle housing's central conduit 13 until the extension member's distal end extends at least partially from the handle housing's distal end. The showerhead 5 is then affixed to the extension member 31 utilizing various fastening methods known to those skilled in the art including a threaded coupling, press-fit attachment, or sonic weld. O-rings may be utilized to provide a fluid tight seal between the extension member 31 and the showerhead 5. The inner supply tube 55 is then slid into the extension member's central conduit 33 until the inner supply tube's proximal end engages the handle housing's proximal end. The inner supply tube 55 is then locked to the handle housing 9 using a female threaded locking collar 67. For aesthetics, the handle assembly 3 may include an upper collar 65. The showerhead assembly's threaded inlet 7 can then be connected to a hose 71 so as to provide a showerhead assembly having an extendable and retractable handle.

The present invention provides an improved handheld shower assembly with an extendable handle. While a preferred showerhead assembly has been illustrated and described, it will be apparent that various modifications can be made without departing from the spirit and scope of the invention. As but one example, the showerhead assembly has been illustrated wherein the extension member's guides extend substantially the length of the extension member, and the housing's annular ring is relatively small and located only at the handle's distal end. However, in an alternative embodiment not shown, the handle housing may include "C" shaped slots formed into the handle housing's inner sidewall wherein the longitudinal portion of the slot extends substantially the length of the handle. For this embodiment, the extension member's guides do not extend longitudinally the length of the extension member, but instead may be formed as simple tabs for sliding within the slots formed into the interior sidewall of the handle's housing. The extension member may be locked in an extendable or retracted condition by rotating the extension member tabs into the upper or lower lateral sections of the "C" shaped slots. Still alternative embodiments may be envisioned by those skilled in the art after consideration of the present disclosure. Accordingly, the present showerhead is not intended to be limited except by the following claim.

I claim:

1. A handheld showerhead assembly comprising:

a showerhead including a front face, a conduit, an inlet, and a plurality of nozzles projecting from said front face, said conduit connecting said inlet to said nozzles for transporting water received from said inlet to said nozzles;

a flexible hose;

an elongate handle having a proximal end connected to said hose and a distal end connected to said showerhead inlet, said elongate handle extending longitudinally to define a longitudinal axis and having an external housing and an extension member;

said external housing having a proximal end, a distal end and a longitudinally extending annular sidewall forming a central conduit, said external housing's proximal end connected to said hose, and said external housing's distal end terminating in a ring having a circular opening with an inner diameter smaller than the diameter of said external housing's central conduit, said ring including a first slot having an edge;

said extension member having a proximal end positioned within said external housing's central conduit and a distal end connected to said showerhead inlet, said extension member having a central conduit for the transportation of water from said hose and said external housing's central conduit to said showerhead inlet, said extension member's sidewall having a diameter substantially the same as said ring's inner diameter wherein said extension member is telescopically slideable within said external housing's central conduit through said ring from a retracted condition to an extended condition and from said extended condition to said retracted condition;

said extension member having a first guide including a longitudinal ridge formed upon the exterior of said extension member sidewall, said longitudinal ridge extending longitudinally substantially the length of said extension member, said first guide further including a proximal lateral ridge and a distal lateral ridge, said proximal lateral ridge having a first end engaging said longitudinal ridge's proximal end and extending laterally and circumferentially upon the exterior of said extension member to terminate at a second end, said distal lateral ridge having a first end engaging said longitudinal ridge's distal end and extending laterally and circumferentially upon the exterior of said extension member to terminate at a second end, both said proximal and distal lateral ridges having a length sufficiently small so as to slide through said first slot, said first guide further including a proximal stop ridge formed upon the extension member's exterior sidewall which extends proximally from said proximal lateral ridge's second end, and said first guide including a distal stop ridge formed upon the extension member's exterior sidewall which extends distally from said distal lateral ridge's second end; and said extension member slideable to said extended condition wherein said first guide's proximal lateral ridge and proximal stop ridge having projected distally through said first slot to the exterior of said external housing's central conduit and wherein said extension member can be rotated relative to said external housing until said first guide's proximal stop ridge engages said first slot's edge to lock said extension member in said extended condition, and said extension member slideable to said retracted condition wherein said first guide's distal lateral ridge and distal stop ridge having projected proximally through said first slot to within said external housing's central conduit and wherein said extension member can be rotated relative to said external housing until said first guide's distal stop ridge engages said first slot's edge to lock said extension member in said retracted condition.

2. The handheld showerhead assembly of claim 1 wherein:

said ring further includes a second slot having an edge; and said extension member has a second guide including a longitudinal ridge formed upon the exterior of said extension member sidewall, said second guide's longitudinal ridge extending longitudinally substantially the length of said extension member, said second guide further including a proximal lateral ridge and a distal lateral ridge, said second guide's proximal lateral ridge having a first end engaging said second guide's longitudinal ridge's proximal end and extending laterally and circumferentially upon the exterior of said extension member to terminate at a second end, said second guide's distal lateral ridge having a first end engaging said second guide's longitudinal ridge's distal end and extending laterally and circumferentially upon the exterior of said extension member to terminate at a second end, both said second guide's proximal and distal lateral ridges having a length sufficiently small so as to slide through said second slot, said second guide further including a proximal stop ridge formed upon the extension member's exterior sidewall which extends proximally from said second guide's proximal lateral ridge's second end, and said second guide including a distal stop ridge formed upon the extension member's exterior sidewall which extends distally from said second guide's distal lateral ridge's second end; and said extension member slideable to said extended condition wherein said second guide's proximal lateral ridge and proximal stop ridge having projected distally through said first slot to the exterior of said external housing's central conduit and wherein said extension member can be rotated relative to said external housing until said second guide's proximal stop ridge engages said second slot's edge to lock said extension member in said extended condition, and said extension member slideable to said retracted condition wherein said second guide's distal lateral ridge and distal stop ridge having projected proximally through said second slot to within said external housing's central conduit and wherein said extension member can be rotated relative to said external housing until said second guide's distal stop ridge engages said second slot's edge to lock said extension member in said retracted condition.

3. The handheld showerhead assembly of claim 1 further comprising:

an inner tube having a proximal end affixed to the proximal end of said external housing and extending longitudinally inside said extension member, said extension member telescopically slideable upon said inner tube with said inner tubes' exterior diameter being substantially the same as the diameter of said extension member's central conduit to provide a substantially fluid tight seal between said inner tube and said extension member when said extension member is extended from said retracted condition to said extended condition and retracted from said extended condition to said retracted condition.

* * * * *